United States Patent [19]

Steinhart

[11] 4,183,704

[45] Jan. 15, 1980

[54] COMPENSATING STACKER FOR PRINTED SIGNATURES

[75] Inventor: Horst K. Steinhart, Anaheim, Calif.

[73] Assignee: Rima Enterprises, Santa Ana, Calif.

[21] Appl. No.: 896,742

[22] Filed: Apr. 17, 1978

Related U.S. Application Data

[63] Continuation of Ser. No. 736,843, Oct. 29, 1976, abandoned.

[51] Int. Cl.[2] ..... B65H 29/34

[52] U.S. Cl. ..... 414/31; 271/192; 414/81

[58] Field of Search ..... 214/6.5, 6 DK, 6 S; 271/192, 218

[56] References Cited

U.S. PATENT DOCUMENTS

| | | | |
|---|---|---|---|
| 2,315,003 | 3/1943 | Martin et al. | 214/6 DK |
| 3,006,258 | 10/1961 | Jochem | 214/6.5 |
| 3,154,307 | 10/1964 | Williamson | 271/192 |
| 3,379,320 | 4/1968 | Loach et al. | 214/6.5 |

FOREIGN PATENT DOCUMENTS

| | | | |
|---|---|---|---|
| 1236412 | 3/1967 | Fed. Rep. of Germany | 214/6 DK |
| 1245113 | 7/1967 | Fed. Rep. of Germany | 214/6 DK |

*Primary Examiner*—Joseph F. Peters, Jr.
*Assistant Examiner*—Ross Weaver

[57] ABSTRACT

There is provided an improved compensating stacker for stitched, folded, stapled, or the like signatures which is characterized by a temporary platform including a pair of counter-rotatable shafts having tines extending therefrom and toward the opposite shaft. The shafts rotate through 360° moving the oppositely extending tines away from beneath a stack portion to drop the stack portion onto a turntable rotatable through 180° after receipt of each stack portion from the temporary platform until a stack of a desired number is built up whereupon the stack is ejected from the turntable.

7 Claims, 6 Drawing Figures

COMPENSATING STACKER FOR PRINTED SIGNATURES

This is a continuation of application Ser. No. 736,843 filed Oct. 29, 1976, now abandoned.

BACKGROUND OF THE INVENTION AND PRIOR ART

The present invention relates, as indicated, to stacking apparatus for signatures from a printing press, for example, and more particularly to a stacker of the compensating type. Books, newspapers, magazines, phamphlets, etc. involving folded over sheets or stapled sheets or a combination of both often have one edge which is somewhat thicker than the opposite edge. When such "signatures" are stacked in the same attitude, the thicker edges build up faster than the free edges to a point where the stack is unstable and difficult to control and handle. To solve this problem, compensating stackers have been provided which are characterized by a channel-way or stacking frame formed of aligning bars extending between an elevated signature delivery point and a turntable receiving plate, the latter being rotatable through 180° on command. Within the stacking frame and intermediate its ends there is provided a temporary platform which gathers a predetermined number of signatures as they exit from the delivery apparatus, such as for example, a tape conveyor. The tape conveyor leads to the stacker from a prior operation, e.g. a trimmer. The signatures are delivered in succession and all in the same attitude. Thus, as the pile portion builds on the temporary platform toward the predetermined number, the thicker edges are all piled one above the other. When the predetermined number in the pile portion is reached, the temporary platform releases or carries the pile portion to a turntable which accepts the pile portion. The turntable is then rotated through 180°.

In the meantime the same, or a different temporary platform is reestablished in the stacking frame to intercept the next successive signatures from the conveyor until another pile portion of equal size to the prior pile portion is accumulated. This pile portion is then released or carried for deposit on top of the preceding pile portion which by now has been rotated through 180°. However, the superimposed thicker edges of the succeeding pile portion are now disposed over the relatively thinner superimposed edges of the next preceding pile portion. In this manner, a compensated stack of a plurality of pile portions each having a predetermined number of signatures therein is built up. When the stack contains a desired total number of signatures (which is a multiple of the predetermined number of signatures in each pile portion) it is ejected from the turntable for further handling, e.g. tying, wrapping, or boxing, for example.

The devices of the present invention are compensating stackers which operate in the same manner as above generally described, but include improved means particularly for releasing a pile portion formed on a temporary platform, and reestablishing the platform.

Representative of prior art in this field are the following: U.S. Pat. No. 1,560,113 to Sandaljian shows a sheet stacking machine with one form of a temporary platform. U.S. Pat. No. 3,568,578 shows a stacker for a rolling press providing a pair of receiving plates in the middle of the channel-way or passage, alternately insertable into the passage and lowered with the signatures and withdrawable at the lower end of the passage and elevatable along the outside of the passage. U.S. Pat. No. 3,880,421 to Muller shows a temporary platform or "aligning members" which swing apart causing the stack formed thereon to drop. U.S. Pat. No. 3,122,230 shows a book dropping apparatus utilizing counter rotating spirals.

Other prior art of interest in connection with apparatus of the type here contemplated include German offenlegungsschrift No. 1,951,506, utilizing a pair of coopera g "star" wheel elements to form a temporary platform; U.S. Pat. Nos. 2,205,767; 2,759,615; 2,886,929; 3,044,772 for an ejection system operated by an air cylinder; U.S. Pat. Nos. 3,486,425; 3,414,257 for collating apparatus; U.S. Pat. Nos. 3,599,965; and 3,768,382.

Among known mechanisms for providing a temporary platform and depending on simultaneously counter-rotable parallel shafts having inwardly extending fingers, a principal example is shown in the aforesaid German offen. No. 1,951,506. Here the rotating members have a "star" wheel configuration of a plurality of radially extending fingers. Opposing fingers of the opposing star wheel elements cooperate to form a horizontal temporary platform on which a pile portion may form. In the subject German reference, the fingers are 120° apart. It has been found that with platform forming elements of this type, the fingers of the next 120° sector when moving into a platform forming position may strike the edge of the pile portion and damage one or more signatures. By utilizing a platform forming element in accordance herewith, this problem is entirely avoided. The fingers forming the temporary platform in the improved devices extend from a single longitudinal element of the parallel shafts and rotate through 360° to reestablish the temporary platform without impacting the pile portion.

The devices of the present invention are of less complicated structure and less expensive to manufacture, maintain, and operate.

BRIEF STATEMENT OF THE INVENTION

Briefly stated, therefore, the present invention is in an improvement in a compensating type stacker relating to the temporary platform for supporting a pile portion consisting of a plurality of signatures. The temporary platform is located intermediate the ends of a stacking frame and is characterized by parallel first and second shafts lying in a common horizontal plane. Each shaft is provided with tines or fingers lying in a single plane and extending from a single longitudinal element of the shaft. In the platform forming position, the tines or fingers on one shaft extend toward the opposite shaft. The shafts are simultaneously counter rotated through 360°, the inwardly extending fingers from both shafts moving away from the bottom of the pile portion to allow the pile portion to drop by gravity onto a turntable rotatable through 180° in a horizontal plane. The shafts complete their respective clockwise and counterclockwise rotation through 360° to reestablish the temporary platform.

In more specific embodiments of this invention, the counter rotatable shafts are adjustably movable toward and away from each other to accommodate signatures of different width.

BRIEF DESCRIPTION OF THE DRAWINGS

The invention may be better understood by having reference to the annexed drawings showing a preferred embodiment of the invention and wherein.

DETAILED DESCRIPTION OF THE DRAWINGS

Figure 1:
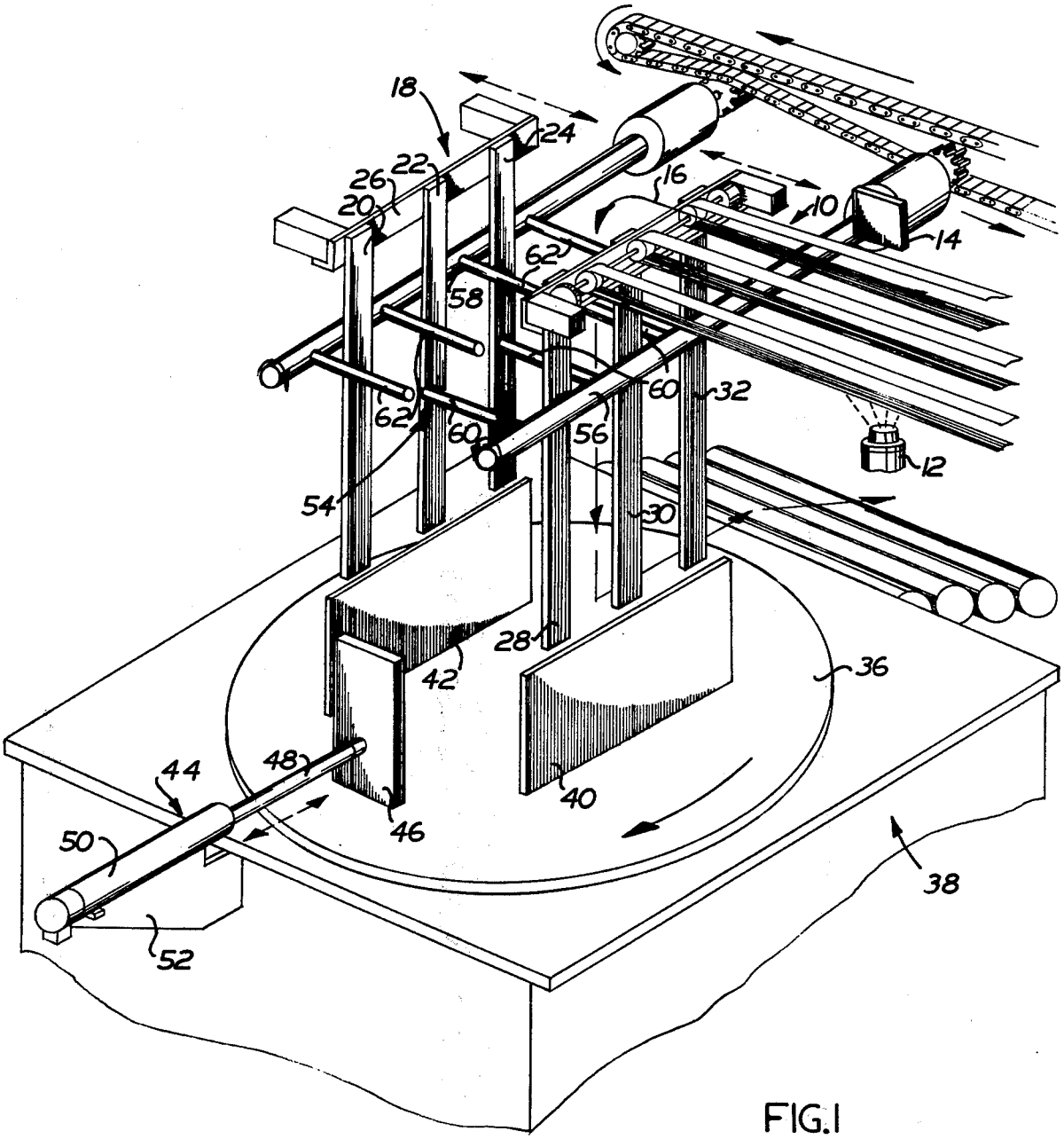
FIG. 1 is a diagrammatic partial perspective view of a compensating stacker in accordance herewith.

Referring more particularly to FIG. 1, there is here shown in diagrammatic partial perspective, a compensating stacker in accordance with the present invention. There is a supporting sidewall and shroud for the device which has been removed for visibility of the parts. Accordingly, there is shown a tape conveyor generally indicated at 10 for accepting signatures from a prior piece of apparatus, such as a trimmer. The tape conveyor 10 is of conventional structure and drive means, and in the present embodiment, it is desirable that the speed of the tape conveyor 10 be adjustable relative to the discharge speed of the apparatus performing the previous operation, e.g. trimming, so that the individual signature being accepted therefrom enter a tape conveyor 10 moving at a slightly greater lineal speed in order to space the signatures apart for counting purposes. Associated with the tape conveyor, then, there is provided any suitable counting means such as for example a light source 12 and a light responsive sensor 14 which registers a count in suitable electronic apparatus (not shown) when the light beam from the light source 12 is interrupted.

The signatures carried by the tape conveyor 10 are discharged along a path indicated by the dotted line 16 into a vertical aligning or stacking frame generally indicated at 18. The frame 18 is adjustable in a known manner to accept signatures of a variety of sizes, within limitations imposed by the dimensions by the machine. A frame 18 is composed of vertical spaced alignment bars, for example alignment bars 20, 22, and 24 extending from a horizontal header bar 26 which is in turn attached to conventional adjustment means, not shown. In like manner from the opposite side, the frame 18 is provided with vertical alignment bars 20, 30 and 32. Suitable end frame members, such as end frame member 34 orthoganally adjustable relative to the previous mentioned frame portions may be provided again, in a known manner.

Figure 5:
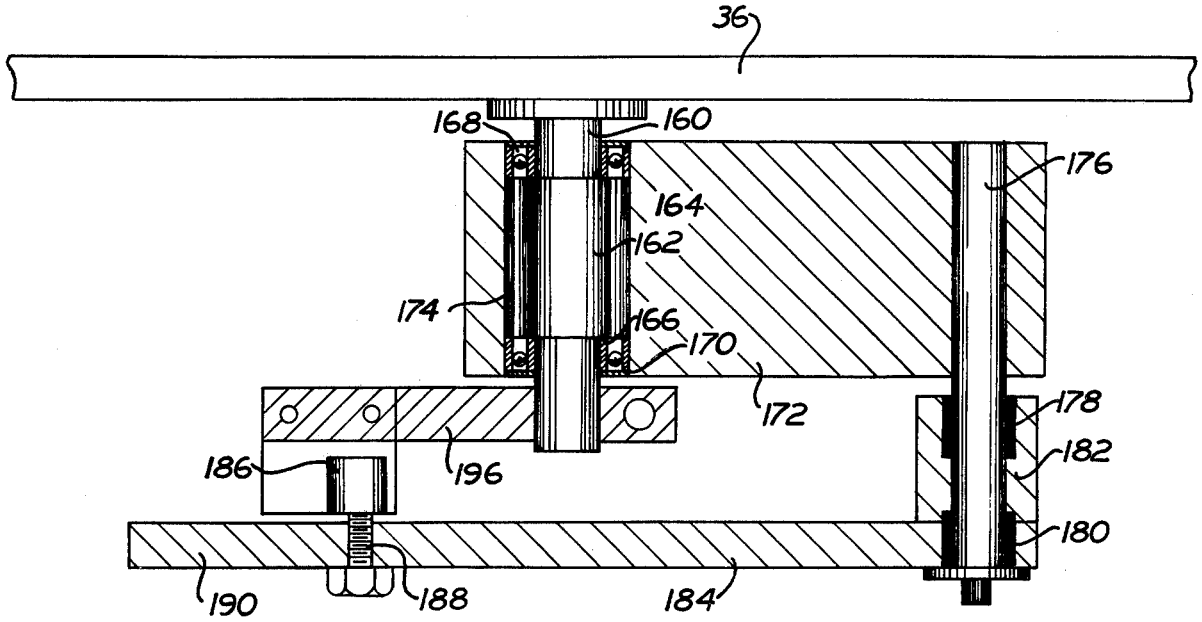
FIGS. 5 and 6 show one form of turntable turning mechanism.
Figure 6:
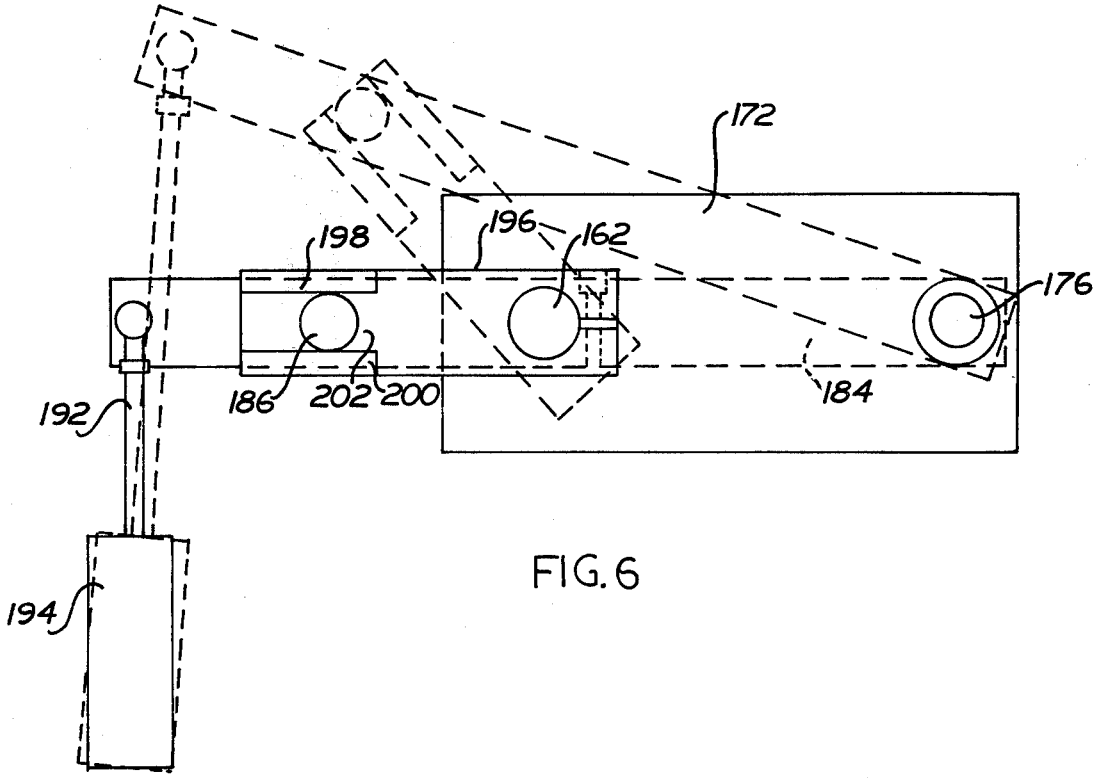

The stacking frame 18 provides, therefore, an adjustable column for accepting signatures from the tape conveyor 10 and collecting them in a stack. The frame 18 is supported above and stationary relative to a turntable 36 mounted for rotation on a suitable base generally indicated at 38. The turntable 36 is rotatable through 180° by any suitable mechanism, e.g. an air operated slide crank mechanism such as shown in FIGS. 5 and 6 and discussed below. Conventional turntable rotation means may be used. The signature receiving surface of the turntable 36 is provided with adjustable vertical plates 40 and 42 adjustably movable toward and away from each other to accommodate the dimension across the opposite marginal edges of a stack of signatures. The turntable 36 is rotatable, for example clockwise through 180°, and upon the next 180° rotation, rotatable counter-clockwise. Alternatively, the turntable 36 may be rotated entirely in one direction, e.g. clockwise or counter-clockwise stopping at 180° intervals.

The adjustable alignment plates 40 and 42 are adjusted so as to be in substantial vertical alignment with the alignment bars 20, 22 and 24 along one marginal edge of the signature, and the alignment bars 28, 30 and 32 along the opposite marginal edge of the signature.

When a suitable number of signatures has been collected on the turntable, it is ejected therefrom as a compensated pile by an ejector generally indicated at 44. The ejector includes a pusher plate 46 mounted at the distal extremity of a rod 48 projecting from an air cylinder 50 suitably supported on a bracket 52 and secured to the base 38. Conventional connections to the cylinder 50 are employed. The rod 48 has an extension sufficient when actuated by the cylinder 50 to push the entire stack of compensated signatures off the turntable 36 and onto a suitable conveyor such as roller conveyor where the compensated stack of signatures is received for wrapping, tying, or boxing by an operator.

To this point, known structures of the compensating stacker apparatus may be employed.

In accordance with the present invention, there is provided intermediate the vertical ends of the alignment frame 18, a temporary platform generally indicated at 54. The temporary platform 54 is adapted to receive a plurality of signatures from the discharge end of the tape conveyor 10 and to accumulate a predetermined number of such signatures thereon. In response to the achievement of said predetermined number is determined by the sensor 14 and associated conventional electronics (not shown), the temporary platform 54 is withdrawn and the pile portion accumulated thereon allow to fall by gravity toward the turntable 36 and within the confines of the alignment bars 20, 22 and 24 along one marginal edge, 28, 30 and 32 along the opposite marginal edge and between the alignment plates 40 and 42 on turntable 36. The temporary support 54 is formed, according to the present invention, from a pair of parallel shafts 56 and 58 which are adjustably spaced and lie in a generally horizontal plane and preferably externally of the stacking frame 18. The ends of the shafts 56 and 58 are suitably carried in bearings mounted in sidewalls not shown. Shaft 56 is provided with a plurality of laterally extending fingers or tines 60 which extend radially from the shaft 56 and lie in a common plane. They are positioned along a single longitudinally extending element or line parallel to the axis of the shaft and on the surface thereof.

In like manner, the shaft 58 is provided with a plurality of inwardly extending fingers or tines 62 all lying in the same plane and extending from a common element or longitudinal line on the surface of the shaft 58 parallel to the axis thereof. The fingers 60 attached to the shaft 56 may be in axial alignment with the fingers 62 extending from the shaft 58, or they may be in staggered partially interleafed relation as desired. They are, nevertheless, spaced so as to be free from interference with the extending alignment bars 20, 22 and 24, and the alignment bars 28, 30 and 32. The shafts 56 and 58 are adapted to rotate in opposite directions as shown by the arrows at the ends of the shafts. Thus, when a pile portion containing a predetermined number of signatures has been deposited on the platform 54, and the count determined by the sensor matches with a preset count, the shafts 56 and 58 are rapidly rotated through 360° to allow the pile portion so formed and accumulated to drop toward the turntable 36 while rapidly reestablishing the temporary platform 54 in time to catch the next signature from the tape conveyor 10.

When the first pile portion has been received on the turntable 36, the mechanism for rotating the turntable 36 is actuated whereby it is turned through exactly 180° to await receipt of a succeeding pile portion now accumulating on the temporary platform 54.

Figure 2:
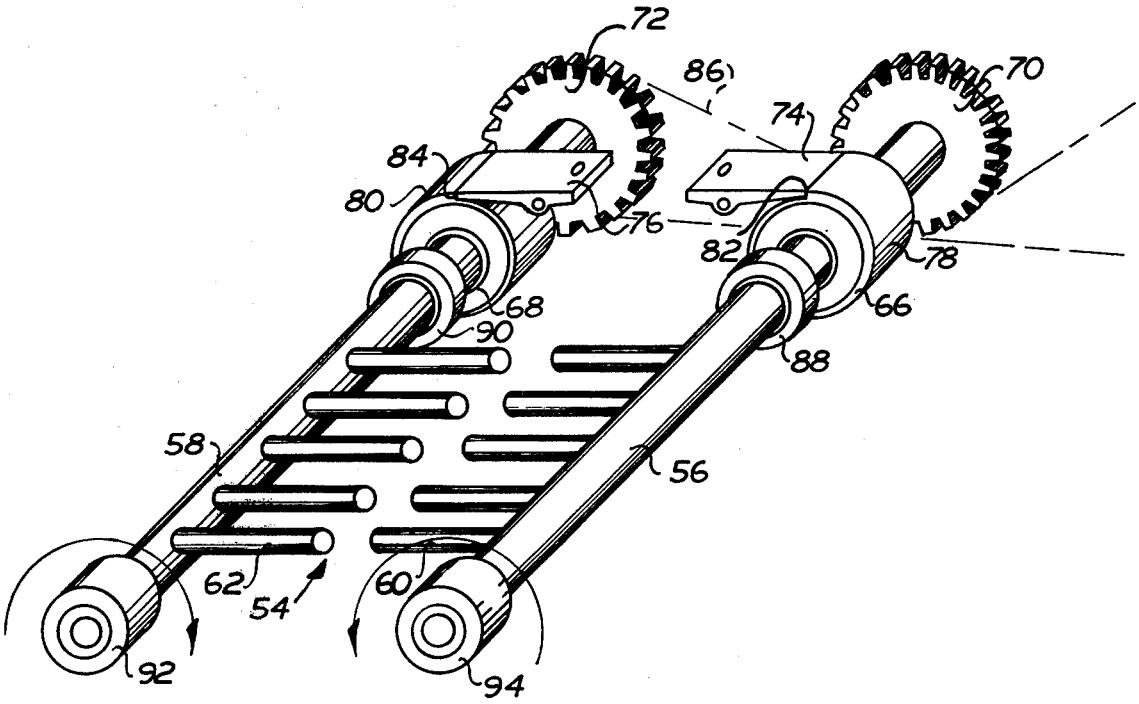
FIG. 2 is a diagrammatic perspective view of the counter-rotating shafts in the temporary platform position and showing single revolution clutches for effecting rotation of said shaft.
Figure 3:
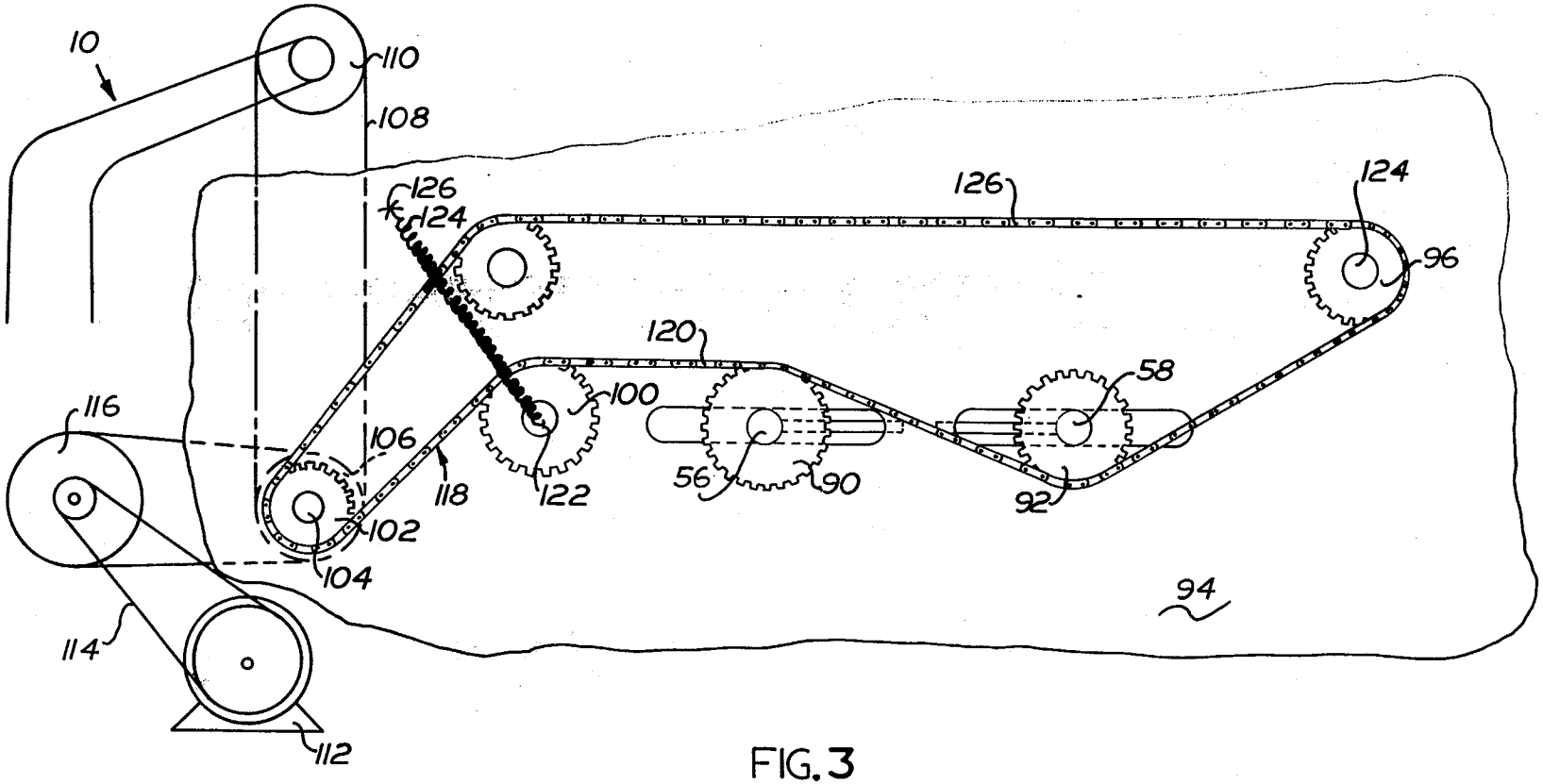
FIG. 3 is a diagrammatic partial side elevation showing drive means for counter-rotating the elements of the temporary platform through 360°.

Referring now more particularly to FIGS. 2 and 3, there is shown in FIG. 3, for example, a drive mechanism for effecting counter rotation of the shafts 56 and 58. FIG. 2 isolates the shafts 56 and 58 for better visibility and shows the single revolution electrically actuated clutches 66 and 68, and the drive sprockets 70 and 72 at the drive ends of the shafts 56 and 58, respectively. The single revolution clutches are well known and commercially available devices. Solenoid means associated with the dogs 74 and 76 are triggered when the predetermined number in a pile portion is reached and in a known manner, the clutches 66 and 68 connect the sprockets 70 and 72 to the shafts 56 and 58, respectively to permit a single rotation thereof. As soon as the sleeves 78 and 80 have rotated respectively counterclockwise and clockwise as shown in FIG. 3, the dogs 74 and 76 engage a step 82 and a step 84, and prevent further rotation and simultaneously disengage the clutches 66 and 68, respectively. Thus, the drive sprockets 70 and 72 continue to rotate freely in response to movement of the chain 86.

The ball bearings 88, 90, 92 and 94 are, as indicated above, carried in sidewalls on the apparatus, not shown.

Referring now more particularly in FIG. 3, there is here shown a drive mechanism for effecting counter rotation of the shafts 56 and 58. The ends of shafts 56 and 58 are provided with sprockets 90 and 92 on the exterior of a side panel 94 of the apparatus hereof. A safety cover plate has been removed to show the chain drive. In approximately the location shown in the drawing of FIG. 3, there are also provided a tail sprocket 96, a turning sprocket 98, an idler sprocket 100 and a drive sprocket 102. The drive sprocket 102 is secured to a shaft 104 which conveniently also is provided with a drive pulley 110 for operating the tape conveyor 10. Motive power is provided by means of a motor 112 connected through a continuously variable clutch drive by means of a belt 114 and a pulley 116.

Power from the motor 112 is transmitted through the shaft 104 and sprocket 102 to a chain 118 reaved in the manner shown in FIG. 3. The lower reach 120 passes over the idler pulley 100 which is mounted on a movable shaft 122 and biased by a coil spring 124 which is secured at 126 to the side panel 94. Thus, the idler sprocket 100 exerts a tension on the chain 118 as determined by the bias of coil spring 124. The lower reach 120 passes over the first sprocket 90 to drive it in a clockwise direction as shown in FIG. 3, and under the sprocket 92 to drive it in a counterclockwise direction at the same rate as the sprocket 90. Sprockets 90 and 92 have the same number of teeth. The lower reach 120 then courses around tail sprocket 96 mounted on a fixed shaft 124 carried by the side panel 94. The upper reach 126 passes over the turning sprocket 98 also mounted on a shaft 128 carried by the side panel 94, and back to the drive sprocket 102. During the operation of the apparatus, the chain 118 is continuously being driven by the sprocket 102 and accordingly, the sprockets 90 and 92 are revolving in opposite direction as shown by the arrows in FIG. 2. The normally disengaged clutches 66 and 68 (FIG. 2) allow the sprockets 90 and 92 to rotate with the chain 118 until such time as the solenoids actuating the dogs 74 and 76 (such solenoids not being shown but conventional with such clutches) to release the sleeves 78 and 80 for a single revolution through 360° whereby the fingers 60 and 62 revolve in opposite directions downwardly away from the bottom of a pile portion carried on the temporary platform 54 (FIG. 1) to drop the pile portion and quickly reestablish the platform 54 after the pile portion has fallen away and without interference from the fingers 60 and 62.

Figure 4:
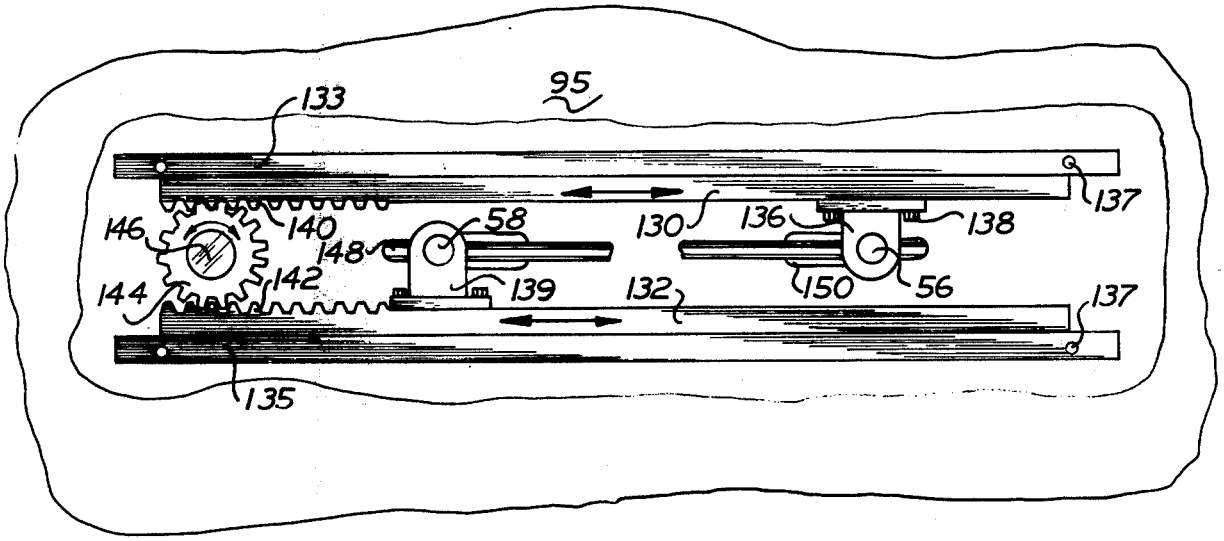
FIG. 4 is an elevation showing rack and pinion adjusting means for moving the shafts toward and away from each other to accommodate different sized signatures.

Referring now more particularly to FIG. 4 there is shown a preferred mode for providing for adjustment of the distance between the shafts 56 and 58, the view of FIG. 4 being taken from the inside of the apparatus looking toward the sidewall 95. A pair of parallel rack bars 130 and 132 are provided for opposite sliding motion in channels, e.g. channels 133 and 135 secured by any suitable means such as fasteners 137 to the sidewall 95 of the apparatus. The rack bar 130 is provided with a bearing block 136 in which the shaft 56 is journaled for rotation. In like manner, the rack bar 132 is provided with a bearing block 139 in which the shaft 58 is journaled for rotation.

The rack bar 130 is provided adjacent one end with a series of gear teeth 140 and in like manner the rack bar 132 is provided with gear teeth 142. A pinion gear 144 is mounted on a shaft 146 and journaled for the sidewall 95. The sidewall 95 is also provided with elongated slots 148 and 150 in which the shafts 56 and 58 are free to move toward and away from each other. Thus, as the pinion 144 is rotated in either a clockwise or counterclockwise direction, the shafts 56 and 58 are caused to move either closer together or farther apart as may be desired to accommodate a given size of signature. The movement of the shafts 56 and 58 is accommodated by the chain 118 as clearly shown in FIG. 3.

In the operation of the apparatus of this invention, electric circuitry is provided which enables the motor 112 to be turned on or off and desirably, the apparatus contains at convenient locations emergency stop switches. The circuitry is also provided with a visible digital counter in which can be set first the predetermined number of signatures to be piled on the temporary support as a pile portion, and a total number of signatures which is a multiple of the predetermined number and indicative of the total number of signatures in a compensated stack. The circuitry is integrated with the counting means shown in FIG. 1, and when the number of signatures exiting from the tape conveyor 10 and lodged within the vertical alignment frame 18 reaches the predetermined number, for example 15, the solenoids operating the 360° clutches 66 and 68 are actuated releasing the clutch whereby the shafts 56 and 58 are turned through 360° causing the fingers 60 and 62 to rotate in opposite direction away from the bottom of the pile portion and allowing it to fall into the turntable 36. Before the next signature has been discharged from the conveyor 10, the temporary platform 54 has been reestablished and the clutches 66 and 68 disengage so that the sprockets 90 and 92 are now free renting relative to the shafts 56 and 58, respectively. While the second pile portion is being built up on the temporary platform 54, the turntable is actuated by known means and rotated through 180°. In the meantime, the second pile portion being accumulated on the temporary platform 54 is building toward the predetermined number whereupon the solenoids actuating the clutches 66 and 68 will be energized as before and effect dropping of the second pile portion on top of the first pile portion onto the table 36. Because of the 180° revolution of the turntable, the thickened marginal edges of the signatures of the second pile portion will be on the opposite side of the pile from the thickened marginal edges of the first pile portion whereby compensating the stack.

When the second pile portion has been received from the temporary platform 54, the turntable 36 is again rotated through 180° to return it to its original position for acceptance of the next pile portion. When the total number of signatures reaches the second number dialed into the electrical circuitry, the air cylinder 50 is actuated by opening, for example a solenoid valve (not shown), and the ejector plate 46 move across the face of the turntable 36 to eject the compensated stack of signatures from the apparatus for further handling.

The apparatus of the present invention is particularly suited for use with bulletins or publications such as annual reports comprising a series of sheets folded in half and stapled along the fold lines. In operation, the fingers 60 and 62 do not come into contact with the pile portions and consequently the top one or two signatures pass through the compensating stacker without damage or impacting from the rapidly moving fingers 60 and 62. The temporary platform 54 is reestablished by the virtue of the 360° revolution of the shafts 56 and 58 and in time for receipt of the next signature delivered by the tape coveyor.

The apparatus is of simple structure, economic to build and operate and remarkably trouble free in actual operation.

What is claimed is:

1. In a compensating stacker for vertically stacking a plurality of signatures having one edge thicker than the remaining edges thereof and compensating for said increased thickness by offsetting successive pile portions by 180°, the improvement which comprises, a vertically disposed dimensionally adjustable stacking frame, a temporary platform for temporarily supporting a plurality of signatures in a pile portion within said stacking frame, said temporary platform including parallel first and second shafts lying in a common horizontal plane, a plurality of fingers extending from each of said shafts toward the other shaft from a single longitudinal element along said shaft and defining a temporary platform for receiving signatures successively and temporarily holding said signatures to form a pile portion having a predetermined number of signatures therein, means for adjusting the space between said first and second shafts, and means responsive to said predetermined number for drivingly rotating said shafts in opposite directions through 360° to drop said pile portion in said stacking frame and re-establish said temporary platform in time relation for receiving the first of the next pile portion of signatures from said signature conveyor, clutch means coacting between each of said shafts and said means for drivingly rotating said shafts and operative to effect 360° rotation of said shafts, means for actuating said clutch means in response to said predetermined number of signatures, and means for disengaging said clutch means after 360° of rotation of said shafts in said opposite directions.

2. In a compensating stacker for vertically stacking a plurality of signatures having one edge thicker than the remaining edges thereof and compensating for said increased thickness by offsetting successive pile portions by 180°, the improvement which comprises in combination a vertically disposed dimensionally adjustable stacking frame, a temporary platform for temporarily supporting a plurality of signatures in a pile portion within said stacking frame, said temporary platform including parallel first and second shafts lying in a common horizontal plane, a plurality of fingers extending from each of said shafts toward the other shaft from a single longitudinal element along said shaft and defining a temporary platform for receiving signatures successively and temporarily holding said signatures to form a pile portion having a predetermined number of signatures therein, means for adjusting the space between said first and second shafts including first and second racks parallel to each other, the first rack having said first shaft attached to it for movement therewith and said second rack having said second shaft attached to it for movement therewith, and a pinion coacting between said racks for moving said racks in opposite directions and means responsive to said predetermined number for simultaneously rotating said shafts in opposite directions through 360° to drop said pile portion in said stacking frame and reestablish said temporary platform.

3. A compensating stacker in accordance with claim 1 wherein said stacking frame is formed of spaced vertical aligning bars.

4. A compensating stacker in accordance with claim 3 wherein the shafts are external of said frame and fingers extend through the spaces between said vertical aligning bars.

5. A compensating stacker in accordance with claim 1 wherein the means for simultaneously rotating said shafts includes sprockets on one end of each shaft, a driven chain reaved to drive said sprockets in opposite directions and each of said shafts having a single 360° revolution clutch coacting between the sprocket and said shaft, said clutches being operative in response to attainment of said predetermined number.

6. A compensating stacker for stacking a plurality of signatures having one edge thicker than the remaining edges thereof and including:

(a) means for delivering a succession of signatures to a dimensionally adjustable stacking frame having spaced vertical aligning bars;

(b) a temporary platform for temporarily supporting a plurality of signatures in a pile portion within said stacking frame, said temporary platform including parallel first and second shafts lying in a common horizontal plane, a plurality of fingers extending from each of said shafts toward the other shaft from a single longitudinal element along the surface of said shaft and defining a temporary platform for receiving signatures successively and temporarily holding said signatures to form a pile portion having a predetermined number of signatures therein, each of said shafts being selectively rotatable simultaneously through 360°, the fingers of said shafts, respectively rotationally moving in a direction away from the bottom of said pile portion of signatures to drop said pile portion by gravity in said stacking frame;

(c) means for adjusting the space between said first and second shafts;

(d) means for drivingly rotating said shafts in opposite directions through 360° after a predetermined number of signatures has been collected in a pile portion on said temporary platform to reestablish said temporary platform, and in timed relation for receiving the first of the next pile portion of signatures from said delivery means, said shaft rotating means including a device member that is continuously rotated, clutch means coaching between said drive member and said shafts to effect rotation of said shafts, means for actuating said clutch means in response to said predetermined number of signatures, and means for disengaging said clutch means after 360° of rotation;

(e) a turntable platform disposed at the bottom of said stacking frame, said turntable being rotatable through 180° after each drop of a pile portion of signatures from said temporary platform to form a compensating stack of signatures;

(f) means for ejecting said compensating stack of signatures from said turntable platform; and (g) means for rotating said turntable through 180°.

7. A compensating stacker in accordance with claim 6 wherein said turntable rotating means includes a three linkage-slide pivot assembly and an extensible arm coacting with one of said links for rotating said turntable through 180° in one direction and 180° in the opposite direction in response to receipt of each pile portion from said temporary platform.

* * * * *

UNITED STATES PATENT AND TRADEMARK OFFICE

CERTIFICATE OF CORRECTION

PATENT NO. : 4,183,704

DATED : January 15, 1980

INVENTOR(S) : Horst K. Steinhart

It is certified that error appears in the above-identified patent and that said Letters Patent are hereby corrected as shown below:

Column 9, line 12, change "device" to --drive--.

Column 9, line 13, change "coaching" to --coacting--.

Signed and Sealed this

*Eighth* Day of *July 1980*

[SEAL]

*Attest:*

SIDNEY A. DIAMOND

*Attesting Officer*

*Commissioner of Patents and Trademarks*